US007093585B2

(12) United States Patent
Bodenhausen et al.

(10) Patent No.: US 7,093,585 B2
(45) Date of Patent: Aug. 22, 2006

(54) FUEL INJECTION VALVE

(75) Inventors: Eckhard Bodenhausen, Steinheim (DE); Horst Kirschner, Brackenheim-Hausen (DE); Gerd Schollenberger, Sersheim (DE); Markus Becker, Sachsenheim (DE); Lutz Schuetze, Bietigheim-Bissingen (DE)

(73) Assignees: Robert Bosch GmbH, Stuttgart (DE), part interest; Parker Hannifin GmbH, Bietigheim-Bissingen (DE), part interest ( * ) Notice: Subject to any disclaimer, the term of this patent is extended or adjusted under 35 U.S.C. 154(b) by 16 days.

(21) Appl. No.: 10/951,694
(22) Filed: Sep. 29, 2004

(65) Prior Publication Data

US 2005/0121001 A1 Jun. 9, 2005

(30) Foreign Application Priority Data

Oct. 2, 2003 (DE) ..... 103 45 965

(51) Int. Cl.
*F02M 61/14* (2006.01)

(52) U.S. Cl. ..... 123/470

(58) Field of Classification Search ..... 123/470
See application file for complete search history.

(56) References Cited

U.S. PATENT DOCUMENTS

| | | | | |
|---|---|---|---|---|
| 3,841,277 | A * | 10/1974 | Schafer | 123/470 |
| 4,201,172 | A * | 5/1980 | Jaggle et al. | 123/470 |
| 4,296,887 | A | 10/1981 | Hofmann | |
| 4,589,596 | A * | 5/1986 | Stumpp et al. | 239/397.5 |
| 6,196,195 | B1 * | 3/2001 | Trutschel et al. | 123/470 |
| 6,892,707 | B1 * | 5/2005 | Reiter et al. | 123/470 |
| 2005/0016501 | A1 * | 1/2005 | Krause et al. | 123/470 |

FOREIGN PATENT DOCUMENTS

| | | |
|---|---|---|
| DE | 38 06 906 A1 | 9/1989 |
| DE | 102 35 445 A1 | 2/2003 |
| GB | 2 022 727 A | 12/1979 |
| JP | 10-281293 | 10/1998 |
| JP | 2000-170628 | 6/2000 |

* cited by examiner

*Primary Examiner*—Thomas N. Moulis
(74) *Attorney, Agent, or Firm*—Ronald E. Greigg

(57) ABSTRACT

A fuel injection valve for a fuel injection system of an internal combustion engine includes a valve housing which is sealed off from an intake tube of an engine by a seal having a bead and a funnel-shaped cuff embodied on the bead, the projecting edge of which cuff is turned-under radially inward.

20 Claims, 2 Drawing Sheets

FUEL INJECTION VALVE

BACKGROUND OF THE INVENTION

1. Field of the Invention

The invention is based on a fuel injection valve for an internal combustion engine.

2. Description of the Prior Art

Fuel injection valves for injecting fuel into an intake tube of an internal combustion engine typically have a seal in the outflow region of the valve housing, by which the valve housing is sealed off from the intake tube.

One such seal, known from German Patent Disclosure DE 26 53 674 A1, is inverted on one end over the fuel injection valve and on the other end over a connection neck of the intake tube and is embodied in accordionlike fashion.

From German Patent Disclosure DE 22 08 646 A1, a seal for sealing off a fuel injection valve from an intake tube of an internal combustion engine is also known. In it, a tip of the fuel injection valve is disposed in a cup-shaped seal which rests on a wall of the intake tube.

A disadvantage of the seals described is in particular that they can only conditionally compensate for center offsets of the fuel injection valve. If there is such a center offset, lateral forces act on the fuel injection valve and under some circumstances cause the sealing action of the seal no longer to be assured.

Particularly the seal known from DE 26 53 674 A1 is unsuitable for the supercharged mode of an internal combustion engine, since in that mode of operation the seal experiences major loads that do not occur in the intake mode.

OBJECT AND SUMMARY OF THE INVENTION

The fuel injection valve of the invention has the advantage over the prior art that the seal has a bead and a cuff embodied on it, with a turned-over edge.

Other advantageous refinements and improvements to the fuel injection valve are disclosed.

Advantageously, a support ring with an L-shaped profile is integrated with the turned-under edge and enables on the one hand the stability of the seal and on the other a function of the seal that compensates for the center offsets.

It is also advantageous that the cuff is embodied as funnel-shaped and is made from an elastic material. As a result, center offsets of the fuel injection valve can be compensated for in a simple way, without impairing the sealing action of the seal.

It is also advantageous that the bead snaps into a constriction of the fuel injection valve, where it is fixed by means of a ring.

For easier assembly, the intake tube may advantageously have a chamfer.

BRIEF DESCRIPTION OF THE DRAWINGS

The invention will be better understood and further objects and advantages thereof will become more apparent from the ensuing detailed description of a preferred embodiment, taken in conjunction with the drawings, in which.

DESCRIPTION OF THE PREFERRED EMBODIMENT

Figure 1:
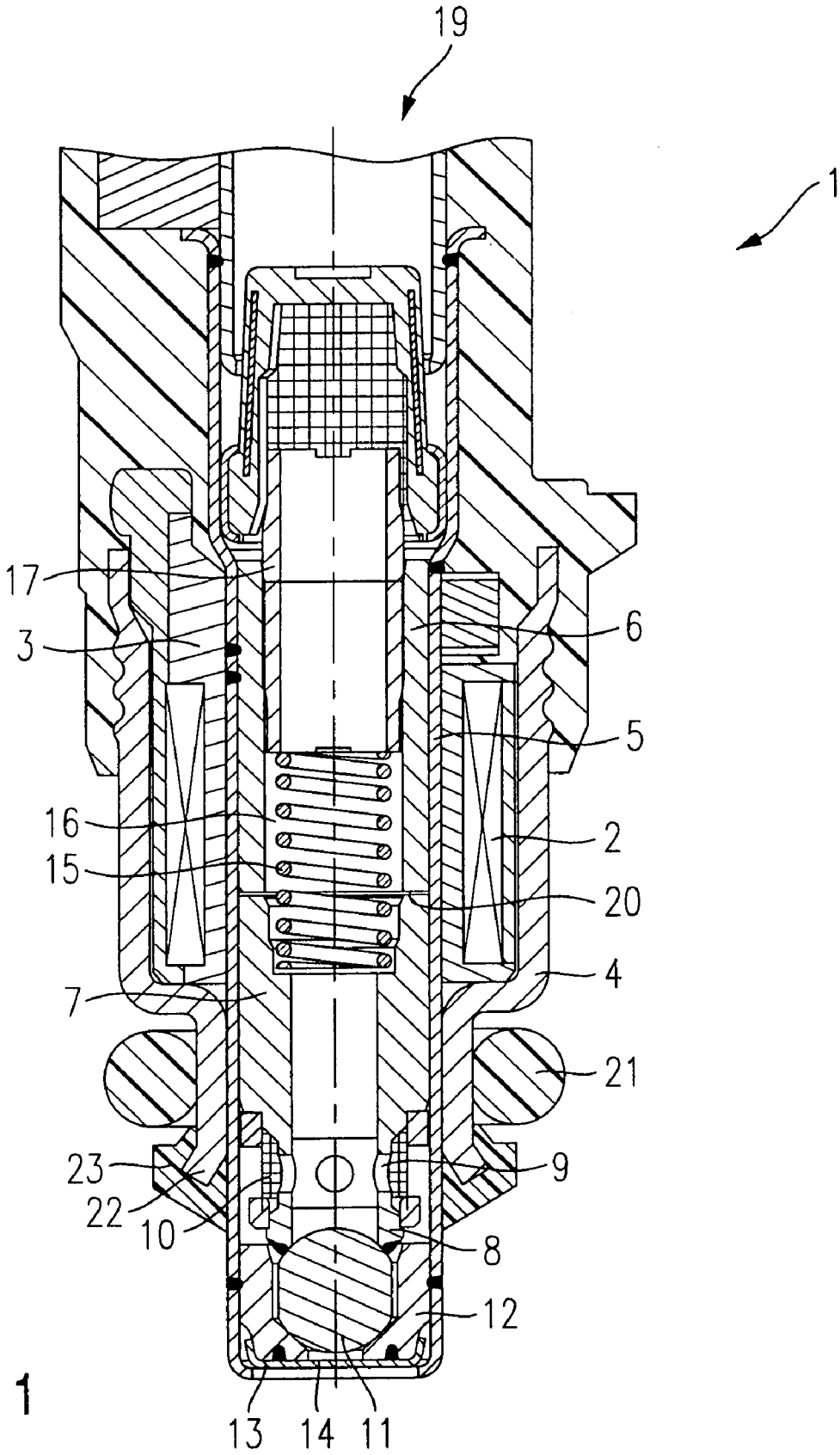
FIG. 1 shows a schematic fragmentary section through one exemplary embodiment of a fuel injection valve in the prior art.

FIG. 1, for the sake of better comprehension of the provisions according to the invention, first, in a fragmentary, schematic sectional view, shows a longitudinal section through the ejection portion of a fuel injection valve 1 of the prior art, which is suitable in particular for injecting fuel into an intake tube, not shown in further detail, of an internal combustion engine.

The fuel injection valve 1 includes a magnet coil 2, which is wound onto a coil holder 3. The coil holder 3 is encapsulated in a valve housing 4.

A tubular valve sleeve 5 reaches through the coil holder 3 and surrounds a support tube 6 that is spread or welded in it and acts as an inner pole of the magnet coil 2. As the outer pole of the magnet coil 2, the valve housing 4 can for instance serve. On the outflow end of the support tube 6, there is an armature 7, which is integral with a valve needle 8. Flow openings 9 are provided in the valve needle 8 that carry the fuel, flowing through the fuel injection valve 1, to a sealing seat.

A ring filter 10 for filtering the fuel may be disposed in the region of the flow openings 9. The valve needle 8 is operatively connected, preferably by welding, to a valve closing body 11, which in the exemplary embodiment is in the form of a ball and which together with a valve seat body 12 forms a sealing seat. Downstream of the sealing seat, in an injection port disk 13, at least one ejection opening 14 is embodied, from which the fuel is injected into the intake tube, not otherwise shown.

In the state of repose of the fuel injection valve 1, the armature 7 is acted upon by a restoring spring 15 such that the fuel injection valve 1 is kept closed by the contact pressure of the valve closing body 11 on the valve seat body 12. The restoring spring 15 is disposed in a chamber 16 in the armature 7 or in the support tube 6 and is prestressed by an adjusting sleeve 17.

On the inflow side of the adjusting sleeve 17, a cup-shaped filter element is preferably press-fitted into the valve sleeve 5. The fuel, which is conducted through a central fuel supply 19, flows through the fuel injection valve 1 through the chamber 16 and the flow openings 9 to the sealing seat and to the ejection opening 14.

If an electric current is supplied to the magnet coil 2 via an electric line, not further shown, a magnetic field builds up, which given adequate strength pulls the armature 7 into the magnet coil 2, counter to the force of the restoring spring 15 and counter to the flow direction of the fuel. As a result, a working gap 20 embodied between the armature 7 and the support tube 6 is closed. As a result of the motion of the armature 7, the valve needle 8, embodied integrally with the armature 7, is likewise carried along in the reciprocating direction, so that the valve closing body 11 lifts from the valve seat body 12, and fuel is carried to the ejection opening 14.

The fuel injection valve 1 is closed as soon as the current that excites the magnet coil 2 is switched off and the magnetic field has decreased to such an extent that the restoring spring 15 presses the armature 7 away from the support tube 6, as a result of which the valve needle 8 moves in the outflow direction, and the valve closing body 11 becomes seated on the valve seat body 12.

The sealing off of the fuel injection valve 1, shown in FIG. 1, from the intake tube, not shown in detail in FIG. 1, of the engine is effected by means of a sealing ring 21, which is slipped over a projecting edge 22 of the valve housing 4 and secured against sliding off by means of a plastic injection-molded coating 23.

A disadvantage of the sealing ring 21 described is in particular that the fuel injection valve 1 must be installed in the center, since because of the installed position and the shape of the sealing ring 21, there are no degrees of freedom available for offsets.

Figure 2:
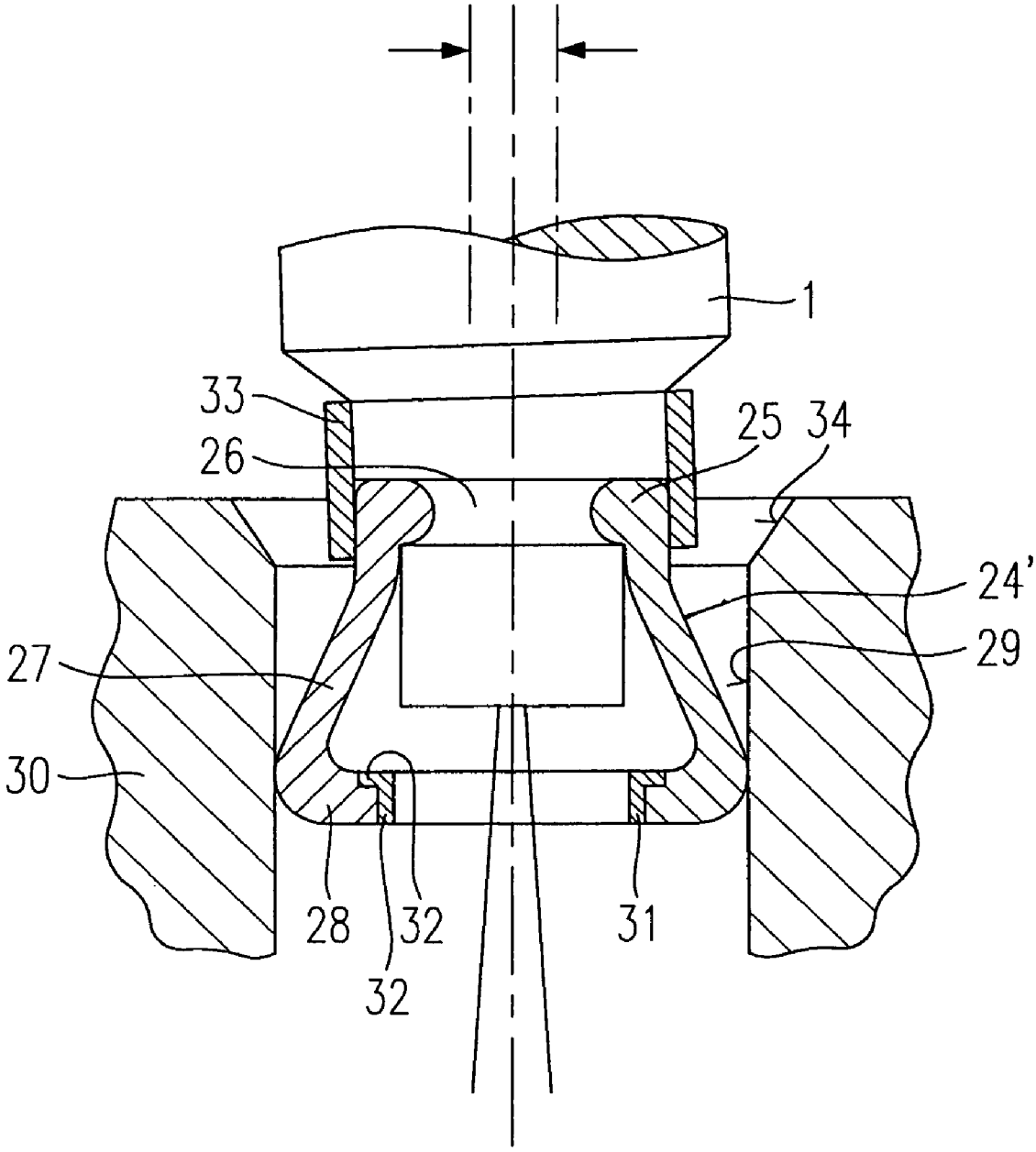
FIG. 2 is a schematic, partly sectional view of the ejection end of an exemplary embodiment of a fuel injection valve designed according to the invention.

By comparison, an exemplary embodiment of a fuel injection valve 1 designed according to the invention, shown in a fragmentary view in FIG. 2, has, instead of the sealing ring 21, a funnel-shaped seal 24' which is slipped onto the plastic injection-molded coating 23.

The seal 24' has an annular bead 25, which is slipped onto the plastic injection-molded coating 23 and snaps into a constriction 26 of the fuel injection valve 1, and also has a funnel-shaped, elastic cuff 27, which widens in the outflow direction and has a projecting edge 28 that is turned under radially inward. In order to expand the cuff 27 and keep it in contact with an inner wall 29 of an intake tube 30, a support ring 31 is preferably placed in the projecting turned-under edge 28. The support ring 31 has a rectangularly L-shaped cross section, having a first leg 32 disposed parallel to the outflow direction and a second leg 32 perpendicular to it in the direction of the fuel injection valve 1.

The support ring 31 assures that on the one hand the long-term stability of the seal 24' is guaranteed, and on the other the fuel injection valve 1 can be operated in both the intake mode and the supercharged mode.

The seal 24' is secured to the fuel injection valve 1 by a slipped-on, preferably metal ring 33. This ring assures that no leakage will occur at the bead 25 even in the supercharged mode.

Advantageously, the fuel injection valve 1, which is preassembled in modular fashion and then inserted into the intake tube 30, can be aligned by the elastic seal 24' in such a way that on the one hand it is supported in a manner free of lateral force, and on the other, the seal 24' can still perform its sealing function. In the process, center offsets of at least ±1 mm can be compensated for, as shown by the opposite side arrows FIG. 2. The elastic, funnel-shaped seal 24' is deformed asymmetrically in the process.

The seal 24' is conceived of such that as many mass-produced parts as possible can be used for the fuel injection valve, so as to fit a given intake tube geometry.

For easier mounting of the seal 24' on the fuel injection valve 1, the intake tube 30 has a chamfer 34 on a side toward the fuel injection valve 1.

The invention is not limited to the exemplary embodiment shown and is suitable for arbitrary designs of fuel injection valves 1, such as fuel injection valves 1 with piezoelectric or magnetostrictive actuators, as well as for use in internal combustion engines for supercharged and intake tube modes of operation. In particular, arbitrary combinations of the individual characteristics are possible.

The foregoing relates to a preferred exemplary embodiment of the invention, it being understood that other variants and embodiments thereof are possible within the spirit and scope of the invention, the latter being defined by the appended claims.

We claim:

1. In a fuel injection valve (1) for a fuel injection system of an internal combustion engine, having a valve housing (4), the valve housing (4) being sealed off from a valve receptacle of an intake tube (30) of the engine by a seal (24'), the improvement wherein the seal (24') has a bead (25) and a cuff (27) embodied on the bead, the projecting edge (28) of which cuff protruding radially inward, further comprising a support ring (31) in the radially inward-protruding edge (28).

2. The fuel injection valve in accordance with claim 1, wherein the support ring (31) has an L-shaped rectangular profile.

3. The fuel injection valve in accordance with claim 1, wherein the cuff (27) is embodied as funnel-shaped and is formed of elastic material.

4. The fuel injection valve in accordance with claim 1, wherein the cuff (27) is embodied as funnel-shaped and is formed of elastic material.

5. The fuel injection valve in accordance with claim 1, wherein the injection valve (1) has a constriction (26) around its outer surfaces, and wherein the bead (25) of the seal (24') snaps into the constriction (26).

6. The fuel injection valve in accordance with claim 2, wherein the injection valve (1) has a constriction (26) around its outer surfaces, and wherein the bead (25) of the seal (24') snaps into the constriction (26).

7. The fuel injection valve in accordance with claim 1, further comprising a ring (33) securing the seal (24') to the fuel injection valve (1).

8. The fuel injection valve in accordance with claim 2, further comprising a ring (33) securing the seal (24') to the fuel injection valve (1).

9. The fuel injection valve in accordance with claim 1, and wherein the seal (24') has resiliency sufficient to compensate for center offsets of at least ±1 mm of the fuel injection valve (1) relative to the intake tube (30).

10. In a fuel injection valve (1) for a fuel injection system of an internal combustion engine, having a valve housing (4), the valve housing (4) being sealed off from a valve receptacle of an intake tube (30) of the engine by a seal (24'), the improvement wherein the seal (24') has a bead (25) and a cuff (27) embodied on the bead, the projecting edge (28) of which cuff protruding radially inward wherein the cuff (27) is embodied as funnel-shaped and is formed of elastic material.

11. The fuel injection valve in accordance with claim 10, wherein the injection valve (1) has a constriction (26) around its outer surfaces, and wherein the bead (25) of the seal (24') snaps into the constriction (26).

12. The fuel injection valve in accordance with claim 10, further comprising a ring (33) securing the seal (24') to the fuel injection valve (1).

13. The fuel injection valve in accordance with claim 10, wherein the seal (24') has sufficient resiliency to compensate for center offsets of at least ±1 mm of the fuel injection valve (1) relative to the intake tube (30).

14. In a fuel injection valve (1) for a fuel injection system of an internal combustion engine, having a valve housing (4), the valve housing (4) being sealed off from a valve receptacle of an intake tube (30) of the engine by a seal (24'), the improvement wherein the seal (24') has a bead (25) and a cuff (27) embodied on the bead, the projecting edge (28) of which cuff protruding radially inward further comprising a ring (33) securing the seal (24') to the fuel injection valve (1).

15. The fuel injection valve in accordance with claim 14, wherein the ring (33) is slipped onto the seal (24') and the fuel injection valve (1).

16. The fuel injection valve in accordance with claim 14, and wherein the seal (24') has resiliency sufficient to compensate for center offsets of at least ±1 mm of the fuel injection valve (1) relative to the intake tube (30).

17. In a fuel injection valve (1) for a fuel injection system of an internal combustion engine, having a valve housing (4), the valve housing (4) being sealed off from a valve receptacle of an intake tube (30) of the engine by a seal (24'), the improvement wherein the seal (24') has a bead (25) and a cuff (27) embodied on the bead, the projecting edge (28) of which cuff protruding radially inward wherein the seal (24') has sufficient resiliency to compensate for center offsets of at least ±1 mm of the fuel injection valve (1) relative to the intake tube (30).

18. The fuel injection valve in accordance with claim 17, wherein the injection valve (1) has a constriction (26) around its outer surfaces, and wherein the bead (25) of the seal (24') snaps into the constriction (26).

19. The fuel injection valve in accordance with claim 18, further comprising a ring (33) securing the seal (24') to the fuel injection valve (1).

20. The fuel injection valve in accordance with claim 17, wherein the seal (24') rests on an inner wall (29) of the intake tube (30).

* * * * *